US008696322B2

(12) United States Patent
Kehrmann et al.

(10) Patent No.: US 8,696,322 B2
(45) Date of Patent: Apr. 15, 2014

(54) PUMP WITH AUTOMATIC DEACTIVATION MECHANISM

(75) Inventors: Michael F. Kehrmann, Lake Zurich, IL (US); Vincent Wen, Taipei (TW); Chun Chung Tsai, Tanshui (TW); Timothy F. Austen, Glencoe, IL (US); Corey Lewison, Buffalo Grove, IL (US)

(73) Assignee: The Coleman Company, Inc., Wichita, KS (US)

( * ) Notice: Subject to any disclaimer, the term of this patent is extended or adjusted under 35 U.S.C. 154(b) by 84 days.

(21) Appl. No.: 13/228,356

(22) Filed: Sep. 8, 2011

(65) Prior Publication Data

US 2011/0318194 A1 Dec. 29, 2011

Related U.S. Application Data

(63) Continuation of application No. 11/804,476, filed on May 17, 2007, now Pat. No. 8,033,797.

(51) Int. Cl.

| | |
|---|---|
| ***F04D 25/08*** | (2006.01) |
| ***A47C 23/047*** | (2006.01) |
| ***F04D 27/00*** | (2006.01) |

(52) U.S. Cl.

USPC ..... 417/44.9; 417/44.2; 417/217; 5/713; 73/715

(58) Field of Classification Search

USPC ..... 417/44.2, 44.9, 217; 5/713; 73/715; 903/915

See application file for complete search history.

(56) References Cited

U.S. PATENT DOCUMENTS

| | | | | |
|---|---|---|---|---|
| 4,447,697 | A * | 5/1984 | Dunne et al. | 219/86.41 |
| 5,526,692 | A * | 6/1996 | Keiser | 73/715 |
| 6,709,246 | B2 * | 3/2004 | Boyd | 417/423.1 |
| 2003/0152673 | A1 * | 8/2003 | Tarlow | 426/118 |

* cited by examiner

*Primary Examiner* — Charles Freay
*Assistant Examiner* — Philip Stimpert
(74) *Attorney, Agent, or Firm* — Kilpatrick Townsend & Stockton LLP

(57) ABSTRACT

An automatic deactivation mechanism is configured for an air bladder pump having a casing and a motor located therein to pump air into an air bladder from the atmosphere and through an air valve connected through the casing. The automatic deactivation mechanism includes a housing positioned within the casing and has defined therethrough a first aperture in fluid communication with the atmosphere through the casing and a second aperture in fluid communication with the air bladder through the casing. Included within the housing are at least two switches and a diaphragm positioned between the switches. The housing is sealed so that when a threshold pressure is reached therein, at least one switch is triggered by deflection of the diaphragm to automatically deactivate the pump by de-energizing the motor.

19 Claims, 7 Drawing Sheets

PUMP WITH AUTOMATIC DEACTIVATION MECHANISM

CROSS-REFERENCES TO RELATED APPLICATION

This application is a continuation of U.S. patent application Ser. No. 11/804,476, filed May 17, 2007, titled "PUMP WITH AUTOMATIC DEACTIVATION MECHANISM," the contents of which are hereby incorporated in its entirety by reference.

BACKGROUND

1. Technical Field

The disclosed embodiments relate to a pump with an automatic deactivation mechanism, and more particularly, to an automatic deactivation mechanism that mechanically triggers a switch to de-energize the pump motor upon reaching a threshold pressure.

2. Related Art

Pumps are known in the art and are used to inflate items of furniture such as air mattresses and beds, which usually contain at least one air bladder. These pumps generally require the user to press and hold an inflate or deflate button until the respective inflation or deflation has completed. Other pumps may require termination of the process of inflation or deflation by manually pressing a switch or knob on the pump, thus preventing the pump motor from continuing to pump and possibly burning out. In either case, a user must attend to the inflation process and wait until the process finishes.

Some alternating current (A/C) air pumps have a resettable fuse that protects the pump by triggering the fuse to blow and the pump to deactivate if the motor starts to overheat. This is a safety measure, however, not an intentional benefit to the consumer, and it can take up to a half hour to reset a blown fuse.

SUMMARY

By way of introduction, the embodiments described below include an automatic deactivation mechanism in a pump for air bladders. The mechanism automatically deactivates the pump when the air bladder reaches either a threshold positive, or vacuum, pressure.

In a first aspect, a pump with an automatic deactivation mechanism includes a motor for inflation of an air bladder by pumping air through an air valve. An impeller for moving air is driven by the motor. A casing retains the motor, the impeller and the air valve. With respect to the air inside of the casing, a first aperture is defined through the casing providing fluid communication with the atmosphere, and a second aperture is defined through the casing providing fluid communication with the air inside the bladder. An automatic deactivation mechanism includes a housing having defined therethrough a third aperture in fluid communication with the first aperture and a fourth aperture in fluid communication with the second aperture. There are at least two switches and a diaphragm positioned between the switches within the housing. The housing is sealed so that when a threshold pressure is reached therein, at least one switch is triggered by deflection of the diaphragm to automatically deactivate the pump by de-energizing the motor.

In a second aspect, a pump with an automatic deactivation mechanism includes a motor for inflation of an air bladder by pumping air through an air valve. An impeller is driven by the motor for moving the air. A casing retains the motor, the impeller and the air valve. With respect to the air inside of the casing, a first aperture is defined through the casing to provide fluid communication with the atmosphere, and a second aperture is defined through the casing to provide fluid communication with the air inside the bladder. An automatic deactivation mechanism includes a sealed housing having defined therethrough a third aperture at a first end thereof that communicates with the second aperture, and a fourth aperture at a second end thereof that communicates with the first aperture. An inflation switch is located near the second end, and within, the housing. A diaphragm is positioned between the third aperture and the inflation switch, wherein when a first predetermined pressure is built up within the bladder during inflation, the inflation switch is triggered by deflection of the diaphragm to de-energize the motor, which automatically shuts off the pump.

In a third aspect, an automatic deactivation mechanism is configured for an air bladder pump having a casing and a motor located therein to pump air into an air bladder from the atmosphere and through an air valve connected through the casing. The automatic deactivation mechanism includes a housing positioned within the casing and has defined therethrough a first aperture in fluid communication with the atmosphere through the casing and a second aperture in fluid communication with the air bladder through the casing. Included within the housing are at least two switches and a diaphragm positioned between the switches. The housing is sealed so that when a threshold pressure is reached therein, at least one switch is triggered by deflection of the diaphragm to automatically deactivate the pump by de-energizing the motor.

In a fourth aspect, an automatic deactivation mechanism for an air bladder pump is configured for an air bladder pump having a casing and a motor located therein to pump air into an air bladder from the atmosphere and through an air valve connected through the casing. The automatic deactivation mechanism includes a housing positioned within the casing and having defined therethrough a first aperture in fluid communication with the atmosphere through the casing and a second aperture in fluid communication with the air bladder through the casing. Included within the housing are at least one switch and a diaphragm positioned proximate the at least one switch. The housing is sealed so that when a threshold pressure is reached therein, the at least one switch is triggered by deflection of the diaphragm to automatically deactivate the pump by de-energizing the motor.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like-referenced numerals designate corresponding parts throughout the different views.

DETAILED DESCRIPTION

In some cases, well-known structures, materials, or operations are not shown or described in detail. Furthermore, the described features, structures, or characteristics may be combined in any suitable manner in one or more embodiments. It will also be readily understood that the components of the embodiments as generally described and illustrated in the Figures herein could be arranged and designed in a wide variety of different configurations.

With reference to FIGS. 1A, 1B, 1C and 2, an automatic deactivation mechanism 100 is shown. The automatic deactivation mechanism includes first and second housings 104A and 104B and first and second covers 106A and 106B. The first and second housings 104A and 104B and first and second covers 106A and 106B are connected to each other in the center of the automatic deactivation mechanism 100, the former to the outside and the latter to the inside. This center connection should form a substantially airtight seal. Both first and second sides of the automatic deactivation mechanism 100, therefore, may be substantially mirrored images of each other. Apertures 108A and 108B are included in respective housings 104A and 104B and may be variably referred to as inlets or outlets of the automatic deactivation mechanism 100. Also provided is a connecting hole 110 through which wires (not shown) or other electrical connections may be routed from the switches 112A and 112B to a pump motor, or to a controller capable of controlling the motor. The electrical connection should be routed through a sealed connection at the wall of each of the housings 104A and 104B to maintain a substantially airtight seal.

Figure 1A:
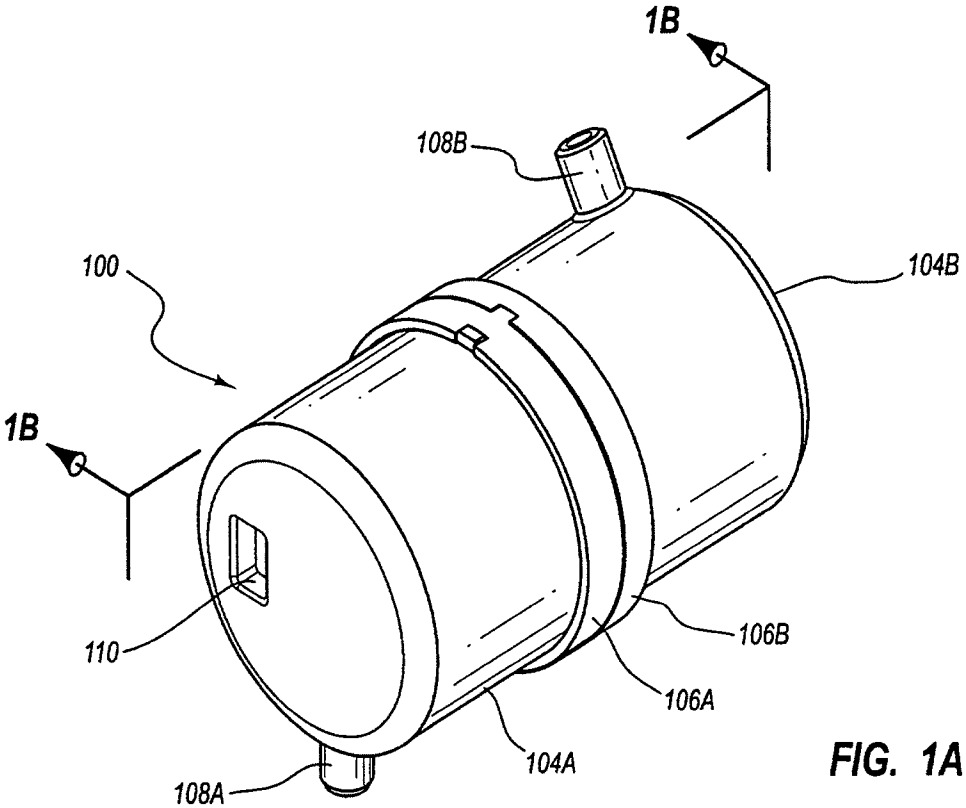
FIG. 1A is a perspective view of an embodiment of a deactivation mechanism disclosed herein.
Figure 1B:
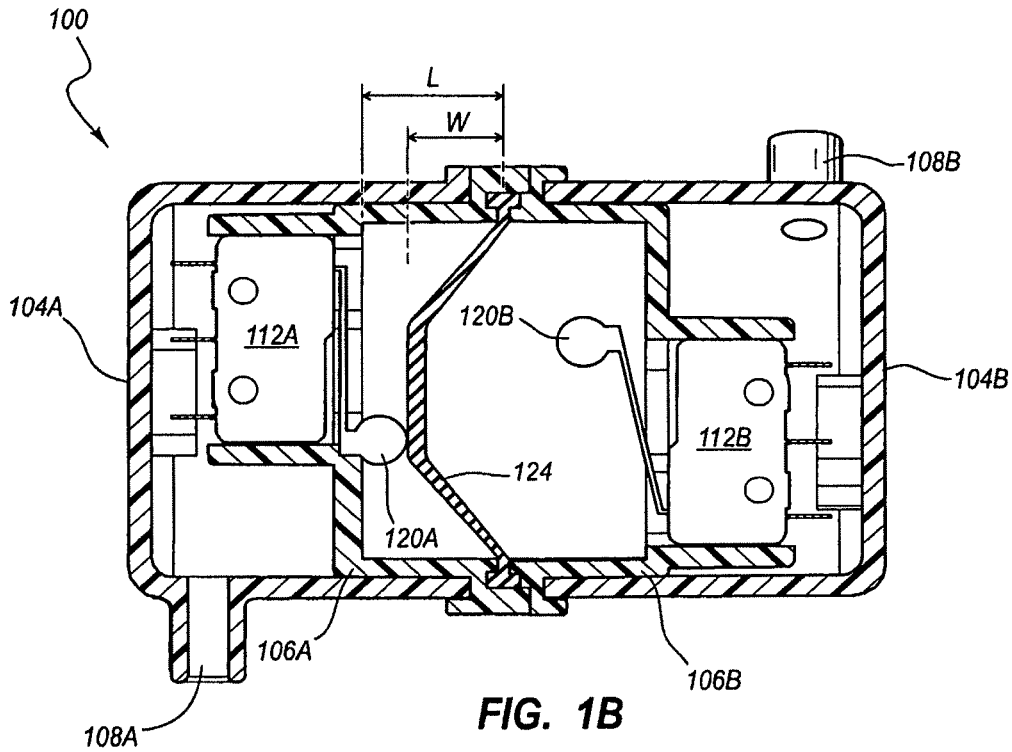
FIG. 1B is a cross-sectional view of the deactivation mechanism from a perspective indicated in FIG. 1A.
Figure 1C:
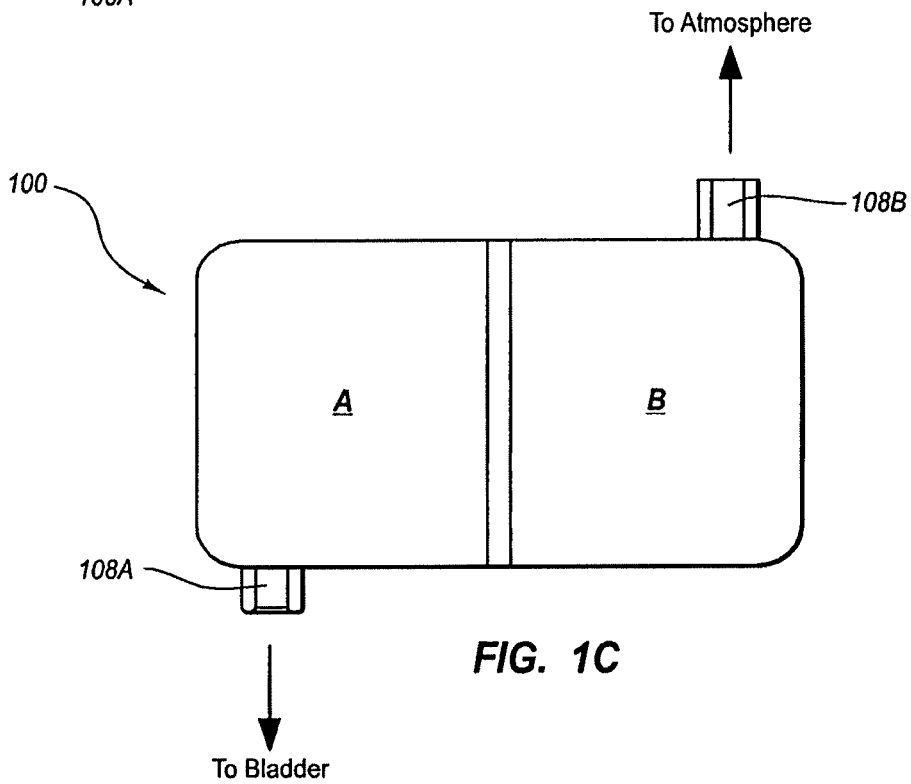
FIG. 1C is a functional diagram showing fluid communication between chamber A of the deactivation mechanism and an air bladder and between chamber B of the deactivation mechanism and the atmosphere.

FIG. 1B is a cross-sectional view of a automatic deactivation mechanism 100 according to one embodiment and from the perspective indicated in FIG. 1A. FIG. 1C is a functional diagram showing fluid communication between chamber A of the automatic deactivation mechanism 100 and a substantially impermeable air bladder (204 in FIGS. 3A, 3B) and between chamber B of the automatic deactivation mechanism 100 and the atmosphere. First and second housings 104A and 104B enable the automatic deactivation mechanism 100 to retain a substantially airtight seal, with the exception of the apertures 108A and 108B defined in respective housings 104A and 104B that allow air to enter and exit, respectively, chambers A and B. The first aperture 108A is in fluid communication with the air bladder and the second aperture 108B is in fluid communication with the atmosphere. A deflation switch 112A is located within the air bladder side (or first end) of the automatic deactivation mechanism 100 while an inflation switch 112B is located within the atmosphere side (or second end) of the automatic deactivation mechanism 100.

When "aperture" is referred to herein, it is not to be limited to mean a simple hole, but may include a shunt device, a filtered passage, a grated opening, etc., so long as fluid (air) communication is established through the housing or casing defining the aperture.

The respective first and second covers 106A and 106B are located to the inside of the switches 112A and 112B. The switches 112A and 112B connect through respective first and second covers 106A and 106B, wherein levers 120A and 120B of the switches 112A and 112B extend into the inside of the covers 106A and 106B. Finally, a pressure-sensitive diaphragm 124 is located and secured between the covers 106A and 106B, and therefore also between the housings 104A and 104B. The diaphragm 124 effectively seals off chamber A from chamber B within the automatic deactivation mechanism 100. The diaphragm 124, therefore, is located between the levers 120A and 120B of the inflation and deflation switches 112A and 112B. The diaphragm 124 may be flexible and concave, so as to deflect between at least two positions under varying levels of pressure, but other configurations apparent to those of skill in the art are within the scope of this disclosure.

The first and second covers 106A and 106B are pre-manufactured of a specific length L to define a distance through which the diaphragm 124 needs to be deflected in order to touch the levers 120A and 120B, which trigger respective switches 112A and 112B. The length L of the first and second covers 106A and 106B, therefore, may be approximately equal to a width W of the concave diaphragm 124, or slightly longer. The stiffness of the diaphragm 124 defines a threshold pressure required before the diaphragm 124 is deflected, and can be designed differently for different air bladders. In one embodiment, the diaphragm 124 may be about 38 millimeters (mm) in diameter with the deflectable portion being about 30 mm in diameter. The flattened portion in the center of the diaphragm 124 may be about 13 mm in diameter. The thickness of the diaphragm 124 may be about 1 mm at the flattened portion, and about 0.87 mm at the transition between the flattened portion and a side portion thereof with that thickness tapering off slightly toward the first and second covers 106A, 106B. An angle between the sides of the diaphragm 124 and the flattened portion may be about 134 degrees. Additionally, the diaphragm 124 may be made of silicon, rubber, or other flexible synthetic materials. The silicon may be furnished as pellets, including TL-8XX where XX is replaced by a two-digit number between 30-70. Silicone molding resin may also be used, furnished as bulk.

Figure 3A:
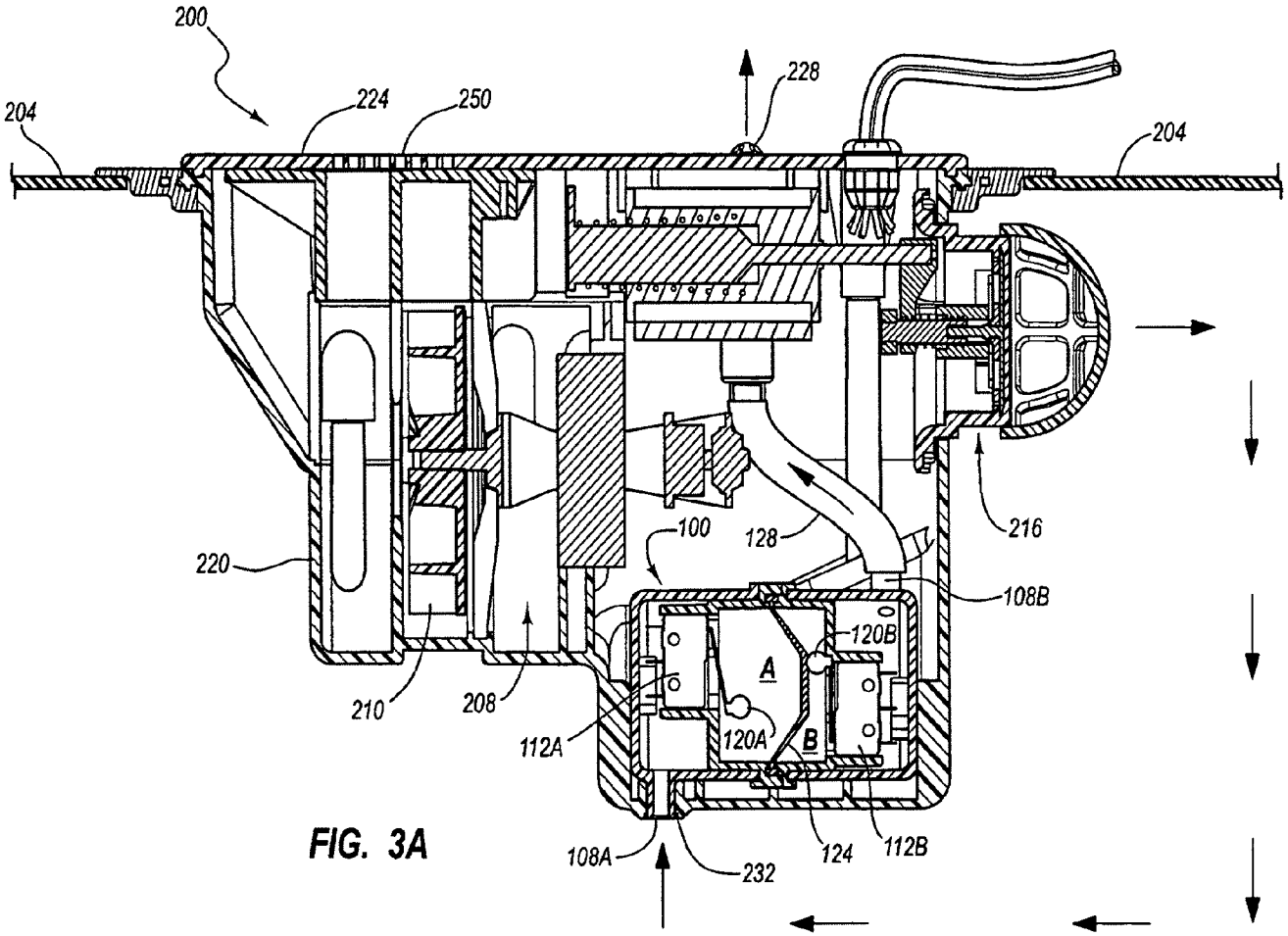
FIGS. 3A and 3B are cross-sectional views of one embodiment of a pump which incorporates the deactivation mechanism during respective inflation and deflation modes.
Figure 3B:
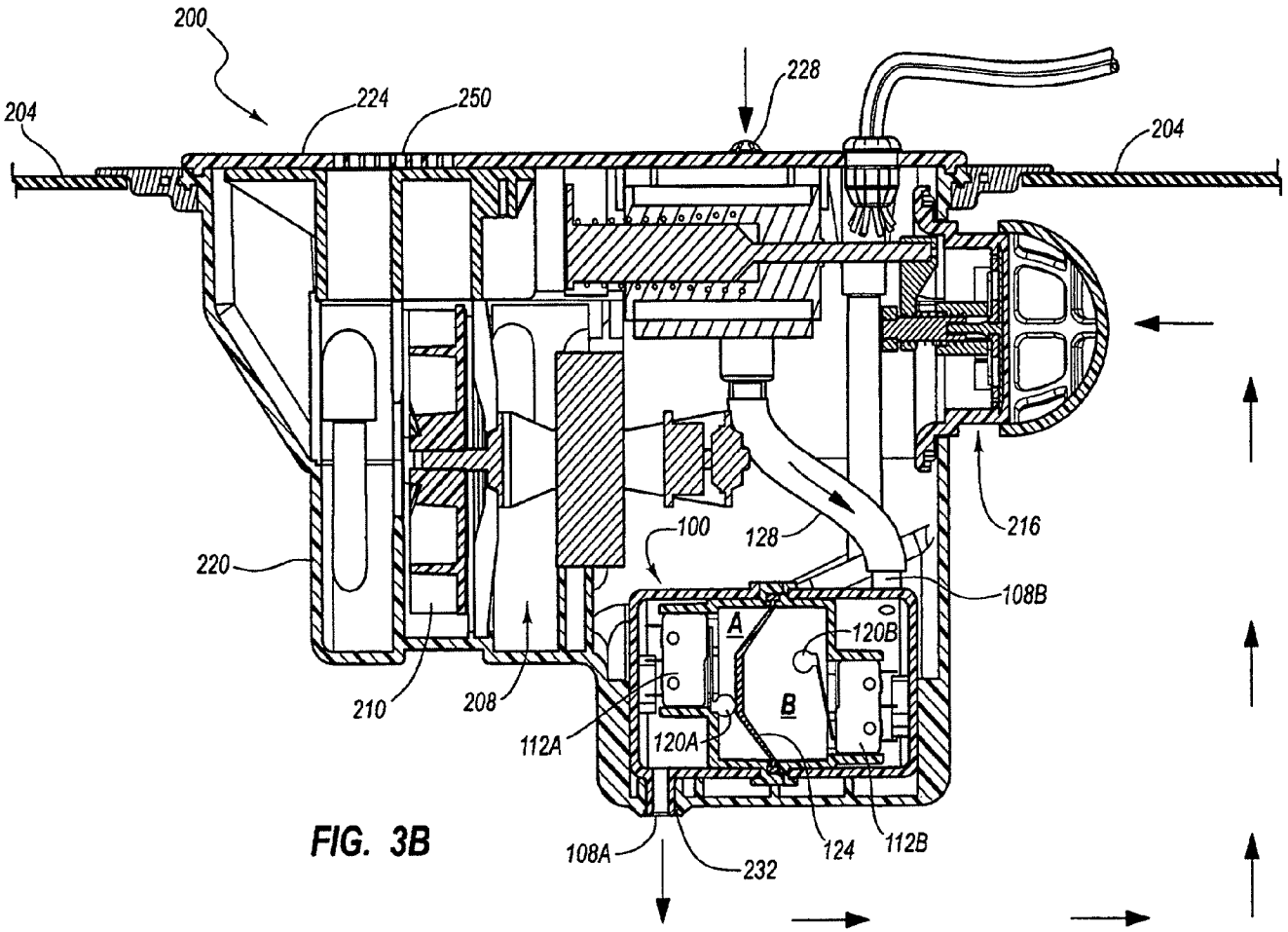

The first and second housings 104A and 104B should also be manufactured so as to contain all the above-described parts within a sealed housing having apertures 108A and 108B that allow the diaphragm 124 to track pressure (positive or vacuum) built up in the air bladder. FIGS. 3A and 3B will further discuss how the automatic deactivation mechanism 100 functions during inflation and deflation modes of operation.

Figure 2:
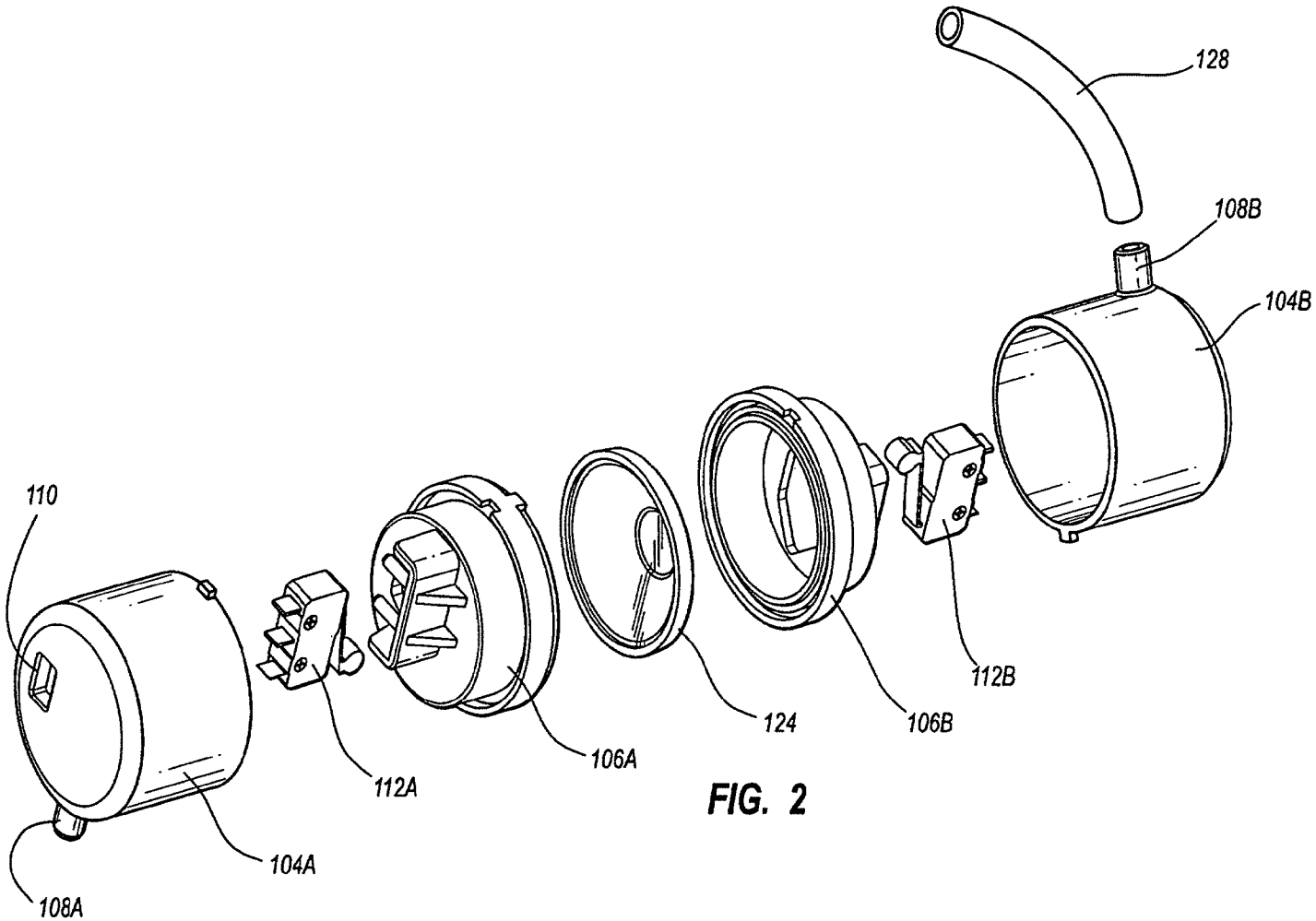
FIG. 2 is an exploded view of the deactivation mechanism of FIGS. 1A and 1B.

FIG. 2 is an exploded view of the automatic deactivation mechanism 100 of FIGS. 1A-1C, showing from left to right (or first end to second end): the first housing 104A; the deflation switch 112A; the first cover 106A; the diaphragm 124; the second cover 106B; the inflation switch 112B; and the second housing 104B. An air tube 128 may also be provided, which connects to the second aperture 108B of the second housing 104B to provide a direct air path to the atmosphere through the internal space of a pump.

FIGS. 3A and 3B are cross-sectional views of one embodiment of a pump 200 incorporating the automatic deactivation mechanism 100. FIG. 3A shows the inflation mode and FIG. 3B shows the deflation mode. The pump 200 can attach to an air bladder 204 (or air mattress or other inflatable furniture items) in a removable manner or permanently, as shown. The pump 200 can be any type of pump known in the art, such as the pump disclosed in U.S. patent application Ser. No. 11/084,219 titled "Reversible Inflation System," which is assigned to the assignee of the present application and hereby incorporated by reference. The pump 200 must be able to at least provide air to the inflatable bladder 204. In another embodiment, the pump 200 can both inflate and deflate the inflatable bladder 204, either by reversing the direction of the pump's motor, or by reversing the airflow through other means, such as the pump disclosed in U.S. patent application Ser. No. 11/084,219. Likewise, where a pump that only inflates is used, a dump valve (not shown) may be provided in the inflatable bladder 204 to enable deflation by forcing air out of the inflatable bladder 204. Such a dump valve may include any aperture that may be selectively unplugged to allow air to escape from the inflatable bladder 204 and thereby deflate.

Understanding that any suitable pump as recognized by one of skill in the art may be used to incorporate therein the automatic deactivation mechanism 100, at least one embodiment will be explained in sufficient detail so that one of skill in the art could so incorporate it in various pumps. The pump 200 contains a motor 208 and an impeller 210 driven by the motor 208 for circulating air through the pump 200. This pump design also includes an air valve 216 which connects through an outer casing 220 of the pump 200, in direct fluid communication with the air bladder 204. The casing 220 may include a pump cover 224, e.g. to provide a side of the pump 200 that is flush with the air bladder 204, through which is defined an aperture 228 in fluid communication with the atmosphere. Another aperture 232 that is in fluid communication with the air bladder 204 is defined through the bottom part of casing 220. The pump cover 224 may also include a grate 250 through which air may exit during deflation operation, or enter during inflation operation. An opening to the atmosphere such as the grate 250 may also be located elsewhere on the pump casing 220 in other embodiments of the pump 200.

The second aperture 108B communicates with aperture 228 so that the former is also in fluid communication with the atmosphere. This fluid communication can be provided by running a tube 128 (or other airtight conduit) between the two apertures through the inside of the casing 220. The first aperture 108A matches up or otherwise communicates with aperture 232 so that both are in fluid communication with the air bladder 204. In this way, the pressure within the air bladder 204 will always be mirrored within chamber A of the automatic deactivation mechanism 100.

While air is pumped through the pump 200 during inflation (FIG. 3A), atmospheric air is forced by the impeller 210, driven by the motor 208, through the air valve 216 and into the air bladder 204. Air enters chamber A through the first aperture 108A and causes the pressure in chamber A of the air bladder 204 to build until the diaphragm 124 is forced to deflect across the automatic deactivation mechanism 100 to trigger the inflation switch 112B by touching its lever 120B. Arrows are shown on the tube 128 to indicate that a quantity of air, however small, is forced out of chamber B when the diaphragm 124 deflects into chamber B to trigger the inflation switch 112B. This small quantity of air is allowed to exit to the atmosphere.

While air is pumped through the pump 200 during deflation (FIG. 3B), air is forced by the impeller 210, driven by the motor 208, through the air valve 216 and into the atmosphere through a grate (250 in FIG. 4) or other outlet in the pump cover 220. The air is thereby forced out of the air bladder 204 and back into the atmosphere. The vacuum air pressure built up in the air bladder 204 as it reaches complete deflation causes the diaphragm 124 to deflect back across the automatic deactivation mechanism 100 to trigger the deflation switch 112A by contacting its lever 120A. Arrows are shown on the tube 128 to indicate that a quantity of air, however small, is forced into chamber B when the diaphragm 124 deflects across into chamber A to trigger the deflation switch 112A. This small quantity of air is allowed to enter from the atmosphere.

Wires (not shown) or other electrical connections from the deflation and inflation switches 112A and 112B may be routed through the automatic deactivation mechanism 100 at the connecting hole 110 and connected to the motor 208 (or a motor controller) so that, when either switch is triggered, the motor 208 is de-energized, thus providing automatic deactivation.

Figure 4:
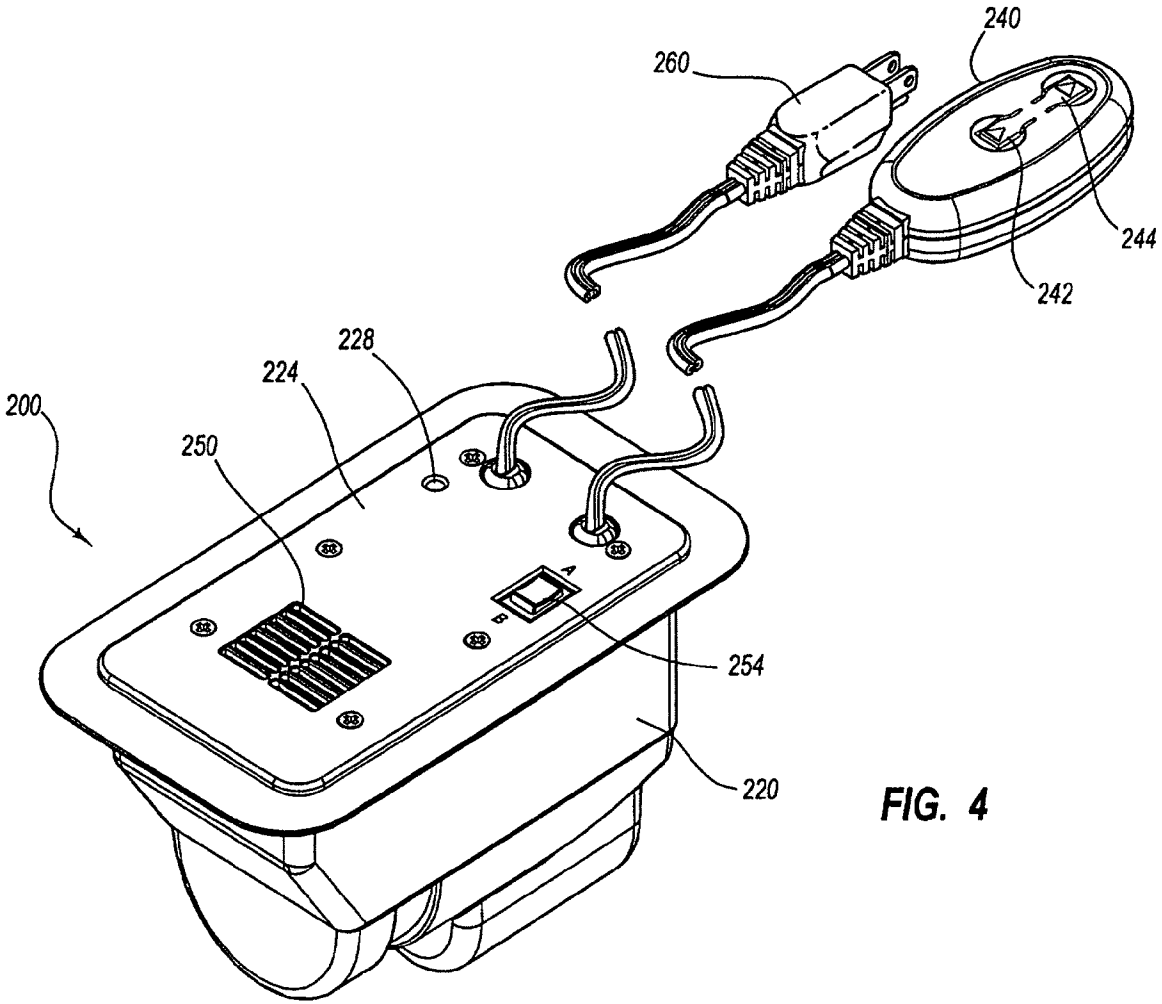
FIG. 4 is a top perspective view of the pump of FIGS. 3A and 3B, together with a wired controller as is optional in an embodiment of the pump.

FIG. 4 is a top perspective view of the pump 200 of FIGS. 3A and 3B, together with an optional wired controller 240 as is optional in an embodiment of the pump 200. The controller 240 may include an inflate button 242 with an indicia such as "Inflate" and a deflate button 244 with an indicia such as "Deflate". The inflate and deflate buttons 242 and 244 correspond, respectively, to signals by which a user causes the pump 200 to incrementally either increase or decrease the firmness of the air bladder 204. The controller 240, therefore, provides comfort level controls by allowing a user to fine tune the firmness of the air bladder 204. In alternative embodiments, the inflate and deflate buttons 242 and 244 may be located on the pump cover 224 or another location of the pump casing 220 accessible to a user. The controller 240, in alternative embodiments, may also be a wireless remote control device that uses infrared or another wireless communication medium known in the art.

The pump cover 224 also includes an auto switch 254 with positions A and B, the former to auto-inflate the air bladder 204 with the pump 200, and the latter to auto-deflate the air bladder 204 with the pump 200. As before, in alternative embodiments, the auto switch 254 may be located elsewhere on the pump casing 224 as long as it is accessible to a user of the pump 200. Likewise, the auto switch 254 may comprise a pair of buttons that respectively activate the inflation and deflation modes of operation. Finally, an electrical cord 260 may run through the pump cover 224 or other location of the casing 220 to provide alternating current (A/C) power to the motor 208, and to power the switches 112A and 112B. Alternatively, a battery compartment could be provided to power the pump 200.

When the auto switch 254 is moved to position A or B, a user can walk away and allow the air bladder 204 to inflate or deflate to a pre-set pressure level, and then the pump 200 automatically turns off. After inflation, the user could then use the controller 240 to adjust the firmness level of the air bladder 204.

Figure 5:
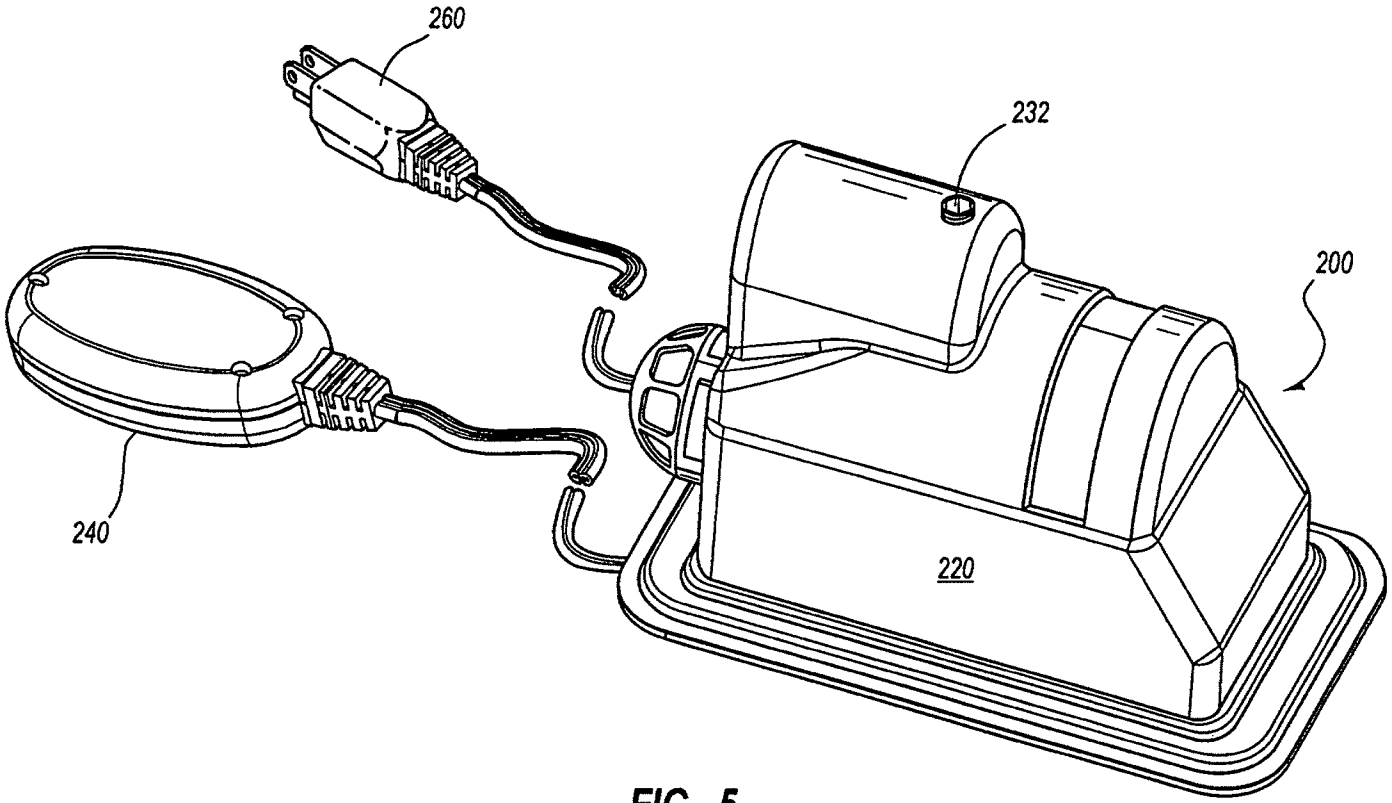
FIG. 5 is a perspective view of the bottom of the pump of FIGS. 3A and 3B.

FIG. 5 is a perspective view of the bottom of the pump 200 of FIGS. 3A and 3B. Note that the aperture 232 located in the bottom part of the pump casing 220 is provided such that the first aperture 108A matches up, or fluidly communicates, with the aperture 232. The aperture 232 may be located elsewhere on the pump casing 220 in alternative embodiments so long as the first aperture 108A fluidly communicates with the inside of the air bladder 200.

In another alternative embodiment, a pump 200 that can only inflate is provided. In such an embodiment, only one switch 112B and corresponding lever 120B is necessary. The deflation switch 112A and corresponding lever 120A could either be eliminated, or they could remain present and simply be non-functional. In such an embodiment, the inflation process proceeds in the same manner as has been previously described. In order to deflate such an embodiment, a dump valve can be provided. Since a vacuum is not formed within the automatic deactivation mechanism, the diaphragm 124 will not be reset to the position shown in FIG. 3B, and the pump 200 will not be able to inflate the inflatable air bladder 204 until the diaphragm 124 is moved out of contact with the lever 120B and the inflation switch 112B is released. In one embodiment, the diaphragm 124 is manufactured of a stiffness that biases the diaphragm 124 in a position located in chamber A as shown in FIG. 3B. When the diaphragm 124 is deflected during inflation to trigger deactivation of the pump 200, the diaphragm 124 will remain in chamber B due to the pressure in the inflatable bladder 204. But, with sufficient self-biasing of the diaphragm 124, it will return to its original position in chamber A as air is dumped out of the dump valve, and thereby be ready to sense a threshold pressure during another inflation cycle to again deactivate the pump 200.

In an embodiment in which the diaphragm is not sufficiently biased with stiffness, a manual solution may be required to reset the diaphragm 124. A manual switch (not shown) can be provided on the outside of the pump 200 or on the controller 240. This switch can operate a mechanism within the automatic deactivation mechanism 100 to move the diaphragm 124 back to the original position. Alternatively, the lever 120B may also include a biasing mechanism (not shown). Such a biasing mechanism would allow the diaphragm to move the lever 120B into contact with the switch 112B when the diaphragm comes into contact with the lever 120B, and then would push the lever 120B back against the diaphragm 124 with enough force to move the diaphragm back into its original position, thus deactivating the inflation switch 112B and allowing the pump 200 to once again inflate the inflatable air bladder 204.

The terms and descriptions used herein are set forth by way of illustration only and are not meant as limitations. Those skilled in the art will recognize that many variations can be made to the details of the above-described embodiments without departing from the underlying principles of the invention. The scope of the invention should therefore be determined only by the following claims (and their equivalents) in which all terms are to be understood in their broadest reasonable sense unless otherwise indicated.

The invention claimed is:

1. A pump with an automatic deactivation mechanism comprising:

a motor for inflation of an air bladder by pumping air from an atmosphere external to the air bladder through an air valve;

an impeller driven by the motor for moving the air;

a casing for retention of the motor and the impeller, the casing including:

(i) a first aperture defined through the casing and providing fluid communication of air between the atmosphere and the impeller;

(ii) a second aperture defined through the casing and through which is connected the air valve for providing selective fluid communication of air between the impeller and an interior of the air bladder;

(iii) a third aperture defined through the casing and providing fluid communication between the atmosphere and an interior of the casing, the third aperture not substantially providing passage of air moved by the impeller; and (iv) a fourth aperture defined through the casing and providing fluid communication between the interior of the casing and air inside the bladder; and an automatic deactivation mechanism comprising:

(i) a housing having defined therethrough a fifth aperture in fluid communication with the third aperture and a sixth aperture in fluid communication with the fourth aperture;

(ii) at least two switches; and (iii) a diaphragm positioned between the switches, the housing being sealed so that when a threshold pressure is reached therein, at least one of said at least two switches is triggered by deflection of the diaphragm to automatically deactivate the pump by de-energizing the motor.

2. The pump of claim 1, further comprising an air tube leading from the fifth aperture to the third aperture to enable fluid communication with the atmosphere.

3. The pump of claim 1, wherein the motor may also deflate the air bladder, and wherein the diaphragm is deflected alternately between the two switches to effect deactivation of the pump when the bladder is fully inflated or deflated to the threshold pressure.

4. The pump of claim 3, wherein the at least two switches comprise a deflation switch and an inflation switch, the deflation switch being positioned at a first end of the housing proximate the sixth aperture and the inflation switch being positioned at a second end of the housing proximate the fifth aperture.

5. The pump of claim 1, further comprising an electrical connection between the switches and the motor to effectuate de-energizing the motor when the threshold pressure of the automatic deactivation mechanism is reached.

6. The pump of claim 1, further comprising a controller in electrical communication with the motor to re-engage the motor after deactivation, thereby enabling a user to adjust the pressure in the bladder.

7. The pump of claim 1, wherein the automatic deactivation mechanism comprises:

a first chamber defined in the housing between the diaphragm and the sixth aperture that is in fluid communication with the bladder via the sixth and fourth apertures; and a second chamber defined in the housing between the diaphragm and the fifth aperture that is in fluid communication with the atmosphere via the fifth and third apertures.

8. A pump with an automatic deactivation mechanism comprising:

a motor for inflation of an air bladder by pumping air from an atmosphere external to the air bladder through an air valve;

an impeller driven by the motor for moving the air;

a casing for retention of the motor and the impeller, the casing including:

(i) a first aperture defined through the casing and providing fluid communication of air between the atmosphere and the impeller;

(ii) a second aperture defined through the casing and through which is connected the air valve for providing selective fluid communication of air between the impeller and an interior of the air bladder;

(iii) a third aperture defined through the casing to provide fluid communication between the atmosphere and an interior of the casing, the third aperture not substantially providing passage of air moved by the impeller; and (iv) a fourth aperture defined through the casing to provide fluid communication between the interior of the casing and air inside the bladder; and an automatic deactivation mechanism comprising:

(i) sealed housing having defined therethrough a fifth aperture at a first end thereof that communicates with the third aperture, and a sixth aperture at a second end thereof that communicates with the fourth aperture;

(ii) an inflation switch located near the second end, and within, the housing; and (iii) a diaphragm positioned between the fifth aperture and the inflation switch, wherein when a first predetermined pressure is built up within the bladder during inflation, the inflation switch is triggered by deflection of the diaphragm to de-energize the motor, which automatically shuts off the pump.

9. The pump of claim 8, wherein the motor may also deflate the bladder, and wherein the automatic deactivation mechanism comprises:

a deflation switch located near the first end, and within, the housing, wherein during deflation of the bladder, when a second predetermined pressure is built up within the bladder, the deflation switch is triggered by deflection of the diaphragm to de-energize the motor, which automatically shuts off the pump.

10. The pump of claim 9, further comprising an electrical connection between the deflation and inflation switches and the motor to effectuate de-energizing the motor when the predetermined pressure of the automatic deactivation mechanism is reached.

11. The pump of claim 9, wherein the first and second predetermined pressures are substantially equivalent, but wherein the first predetermined pressure is a positive pressure and the second predetermined pressure is a vacuum pressure.

12. The pump of claim 9, further comprising a controller to re-engage the motor after deactivation, thereby enabling a user to adjust the pressure in the bladder.

13. The pump of claim 8, further comprising an air tube leading from the fifth aperture to the third aperture to provide fluid communication with the atmosphere.

14. The pump of claim 13, wherein the automatic deactivation mechanism comprises:

a first chamber defined in the housing between the diaphragm and the sixth aperture that is in fluid communication with the bladder; and a second chamber defined in the housing between the diaphragm and the fifth aperture that is in fluid communication with the atmosphere through the air tube.

15. An automatic deactivation mechanism for an air bladder pump having a casing and a motor located therein to pump air into an air bladder from an atmosphere external to the air bladder and through an air valve connected through the casing, the deactivation mechanism comprising:

a housing positioned within the casing, the housing having defined therethrough a first aperture in fluid communication with the atmosphere through the casing, the first aperture not substantially providing passage of air moved by the pump, and the housing having defined therethrough a second aperture in fluid communication with the air bladder through the casing;

at least two switches; and a diaphragm positioned between the switches, the housing being sealed so that when a threshold pressure is reached therein, at least one of said at least two switches is triggered by deflection of the diaphragm to automatically deactivate the pump by de-energizing the motor.

16. The automatic deactivation mechanism of claim 15, wherein the motor may also deflate the air bladder, wherein the at least two switches comprise a deflation switch and an inflation switch, the deflation switch being positioned at a first end of the housing proximate the second aperture and the inflation switch being positioned at a second end of the housing proximate the first aperture.

17. The automatic deactivation mechanism of claim 16, wherein the threshold pressure reached during deflation comprises a vacuum pressure from the air being removed from the bladder.

18. The automatic deactivation mechanism of claim 17, further comprising:

an electrical connection between the inflation and deflation switches and the motor to cause the motor to de-energize, and thus automatically deactivate, when the threshold pressure is reached.

19. An automatic deactivation mechanism for an air bladder pump having a casing and a motor located therein to pump air into an air bladder from an atmosphere external to the air bladder and through an air valve connected through the casing, the automatic deactivation mechanism comprising:

a housing positioned within the casing, the housing having defined therethrough a first aperture in fluid communication with the atmosphere through the casing, the first aperture not substantially providing passage of air moved by the pump, and the housing having defined therethrough a second aperture in fluid communication with the air bladder through the casing;

at least one switch; and diaphragm positioned proximate the at least one switch, the housing being sealed so that when a threshold pressure is reached therein, the at least one switch is triggered by deflection of the diaphragm to automatically deactivate the pump by de-energizing the motor.

* * * * *